United States Patent [19]

Chanforan et al.

[11] Patent Number: 4,606,724

[45] Date of Patent: Aug. 19, 1986

[54] SIMULATOR FOR FIRING SMALL-BORE GUNS AT SIMULATED TARGETS

[75] Inventors: Henri Chanforan, Cergy; Alain Pelletier, Plaisirs, both of France

[73] Assignee: Thomson CSF, Paris, France

[21] Appl. No.: 556,117

[22] Filed: Nov. 29, 1983

[30] Foreign Application Priority Data

Nov. 30, 1982 [FR] France ..... 82 20044

[51] Int. Cl.[4] ..... G09B 9/00

[52] U.S. Cl. ..... 434/20; 434/16

[58] Field of Search ..... 434/16, 20

[56] References Cited

U.S. PATENT DOCUMENTS

| | | | |
|---|---|---|---|
| 3,691,284 | 9/1972 | Borjeson | 434/20 |
| 4,276,028 | 6/1981 | Gwynn | 434/20 |
| 4,302,191 | 11/1981 | Weibull | 434/20 |
| 4,457,716 | 7/1984 | Eserhaut et al. | 434/20 |
| 4,474,501 | 10/1984 | LaRussa | 434/43 |
| 4,534,735 | 8/1985 | Allard et al. | 434/20 |

FOREIGN PATENT DOCUMENTS

| | | | |
|---|---|---|---|
| 0100719 | 7/1983 | European Pat. Off. | 434/20 |
| 2658501 | 6/1978 | Fed. Rep. of Germany . | |
| 2746534 | 4/1979 | Fed. Rep. of Germany . | |
| 2141124 | 1/1973 | France . | |
| 2420737 | 10/1979 | France . | |
| 2500148 | 8/1982 | France . | |
| 8101875 | 7/1981 | PCT Int'l Appl. . | |

*Primary Examiner*—Leo P. Picard

*Attorney, Agent, or Firm*—Cushman, Darby & Cushman

[57] ABSTRACT

Apparatus for simulating the firing of weapons against simulated aerial targets. Images of a target, tracers and an aiming point are reflected in the gunsight by a collimator and a mirror. Sensors serve to define the orientation of the gun and the instants of firing. A video recorder supplies the image of the target and of the aiming point. An electronic logic circuit and a control desk serve to displace the image of the target according to the recorded trajectory and the movements of the gun.

6 Claims, 17 Drawing Figures

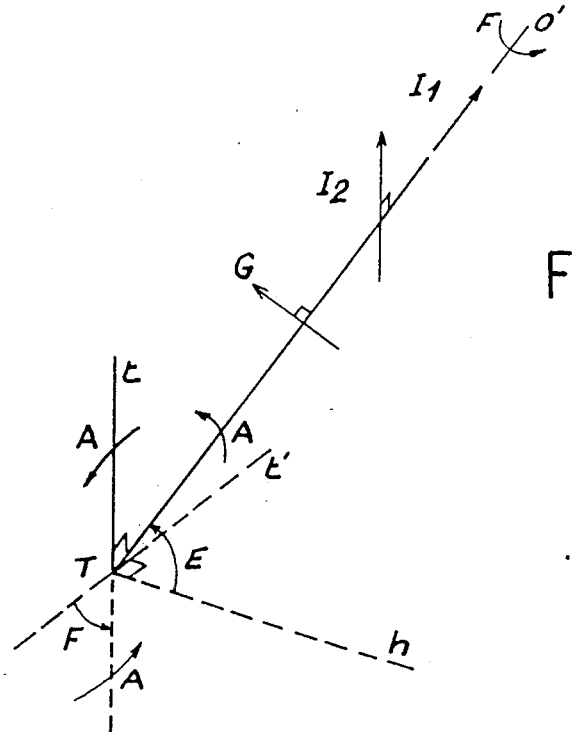
FIG. 7
FIG. 8
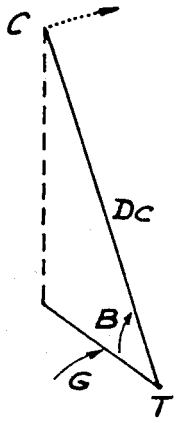
FIG. 9
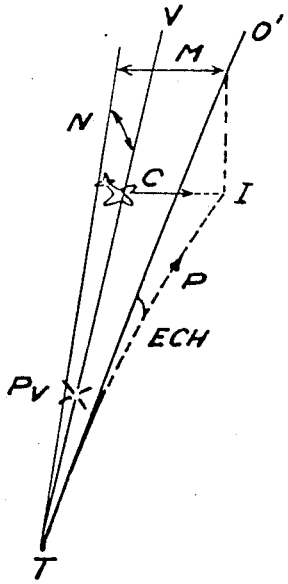

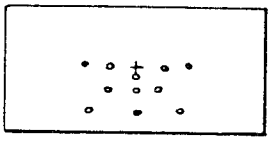
FIG.10
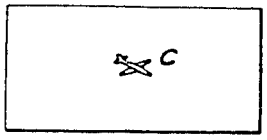
FIG.12
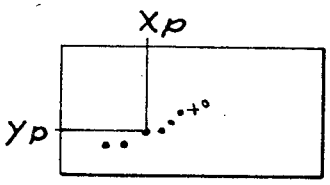
FIG.11
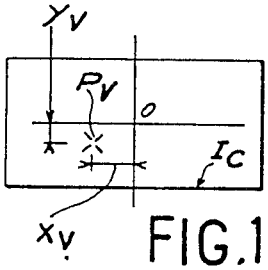
FIG.13
FIG.14
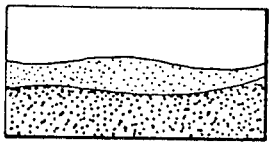
FIG.15
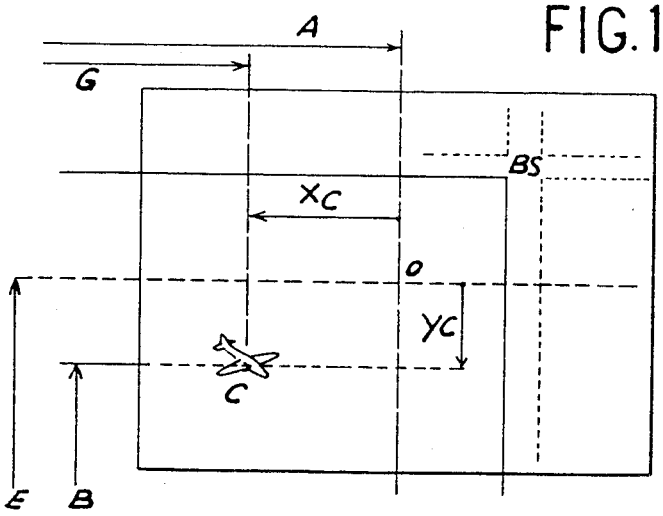

SIMULATOR FOR FIRING SMALL-BORE GUNS AT SIMULATED TARGETS

BACKGROUND OF THE INVENTION

This invention relates to the firing of small-bore guns at moving targets and mainly at air targets which attack at low altitudes.

For obvious reasons, field training as well as real firing are attended by many difficulties such as lack of availability of training grounds, safety regulations to be observed, wasted periods spent in traveling to firing ranges and in preparations for firing, weather conditions, and in some cases the high cost of fuel consumed by motor vehicles.

Although training under real conditions remains essential, there is a tendency at the present time to carry out such training only during a final application stage after basic indoor training provided by simulators.

By means of firing simulators, different types of firing equipment with their operation and utilization characteristics can be reproduced economically and with a sufficient degree of realism and fidelity. Training can thus be provided in a systematic and flexible manner by means of reproducible exercises under the supervision of a minimum number of instructors.

The simulator in accordance with the invention is intended to provide indoor training in aiming by estimation and in firing by means of guns fitted with gunsights of the grid type shown in FIG. 10 of the accompanying drawings.

When aiming by means of a reticle in the conventional manner, the shooter orients the gun in order to obtain a view of the target in the gunsight at a location with respect to said reticle which is a function of the firing conditions. Similarly, in the case of a sighting grid, the position in which the target is to be placed with respect to the different circles of said grid must be determined instinctively by the firer.

The simulator is mounted on a gun which may not be provided with its tube and is more particularly associated with the grid sight of said gun by means of optical devices and by means of a television monitor.

It is readily apparent that the simulator can also be employed on a tank or on any vehicle equipped with a gun.

The simulator causes a target and an "aiming point" to appear in the field of the gunsight. In order to obtain a correct aim, the firer then has to bring the target onto the aiming point by suitable orientation of the gun. Firing of the shot is represented in the gunsight by the appearance of tracers having trajectories which comply with the laws of ballistics. A successful shot is indicated by a higher degree of brightness of the tracer at the point of impact on the target. When the operator has acquired a certain level of experience, he is able to determine on his own initiative the circle in which the target is to be placed. The aiming point is then suppressed and the final stage of the aiming exercise consists in using the sighting grid alone.

In French Pat. No. 2 500 148, there was described a training simulator for firing small-bore guns by means of an aiming point of the type mentioned in the foregoing. This simulator relates to training with real targets.

SUMMARY OF THE INVENTION

In accordance with one feature of the invention, the image of the target and the image of the aiming point are obtained from data supplied by a video recorder and formed of analog data of the target image, for digital data representing the coordinates of the target with respect to the gun, and of digital data which define the coordinates of the aiming point in the gunsight. These sets of data have been recorded conjointly on a magnetic tape, image by image.

Since the main object of a simulator of this type is to train personnel in firing at low-flying targets, it is essential to ensure that the ground can appear and move within the gunsight according to the elevation of the gun but the representation of the ground can be as simple as possible. The transit time of a target is in fact on the order of about twenty seconds. As the firer concentrates his vision on the target and on the sighting grid, he instinctively takes his bearings with respect to the ground but does not pay any attention to any details which may be located on the ground. The ground representation can therefore be limited to the skyline, to a crest line, or to ground-fold lines. All these lines will hereinafter be designated as skylines.

In accordance with another feature of the invention, the ground is represented by separate and distinct zones of luminance, the limits of which simulate skylines. These lines are each determined by a set of digital data stored in a memory, the data being all read at each scan of one line of the image supplied by the video recorder, starting from an initial data item determined by rotation of the gun.

BRIEF DESCRIPTION OF THE DRAWINGS

FIG. 7 provides a definition of the angles of orientation of the gun as well as the angles of orientations of the sensitive axes of sensors associated with the gun.

FIG. 8 provides a definition of the coordinates of the target.

FIG. 9 illustrates the principle of aiming by the shooter who places the aiming point in coincidence with the target in the gunsight.

FIG. 10 illustrates the sighting grid as observed in the gunsight.

FIG. 11 shows a burst of tracers observed in the gunsight.

FIG. 12 is one of the images recorded in analog form on a magnetic tape and representing a target located at the center of the images.

FIG. 13 shows the aiming point consisting of a cross in this example, in which the coordinates Xv and Yv in the gunsight are recorded in the form of digital data M and N in association with the target images.

FIG. 14 shows three distinct zones of luminance corresponding to two simulated skylines delivered by the skyline generator GH of FIG. 3.

FIG. 15 illustrates the target in the gunsight or on the screen of the television monitors, the target being located with respect to the central axes by means of its coordinates Xc and Yc.

DESCRIPTION OF THE PREFERRED EMBODIMENT

Figure 1:
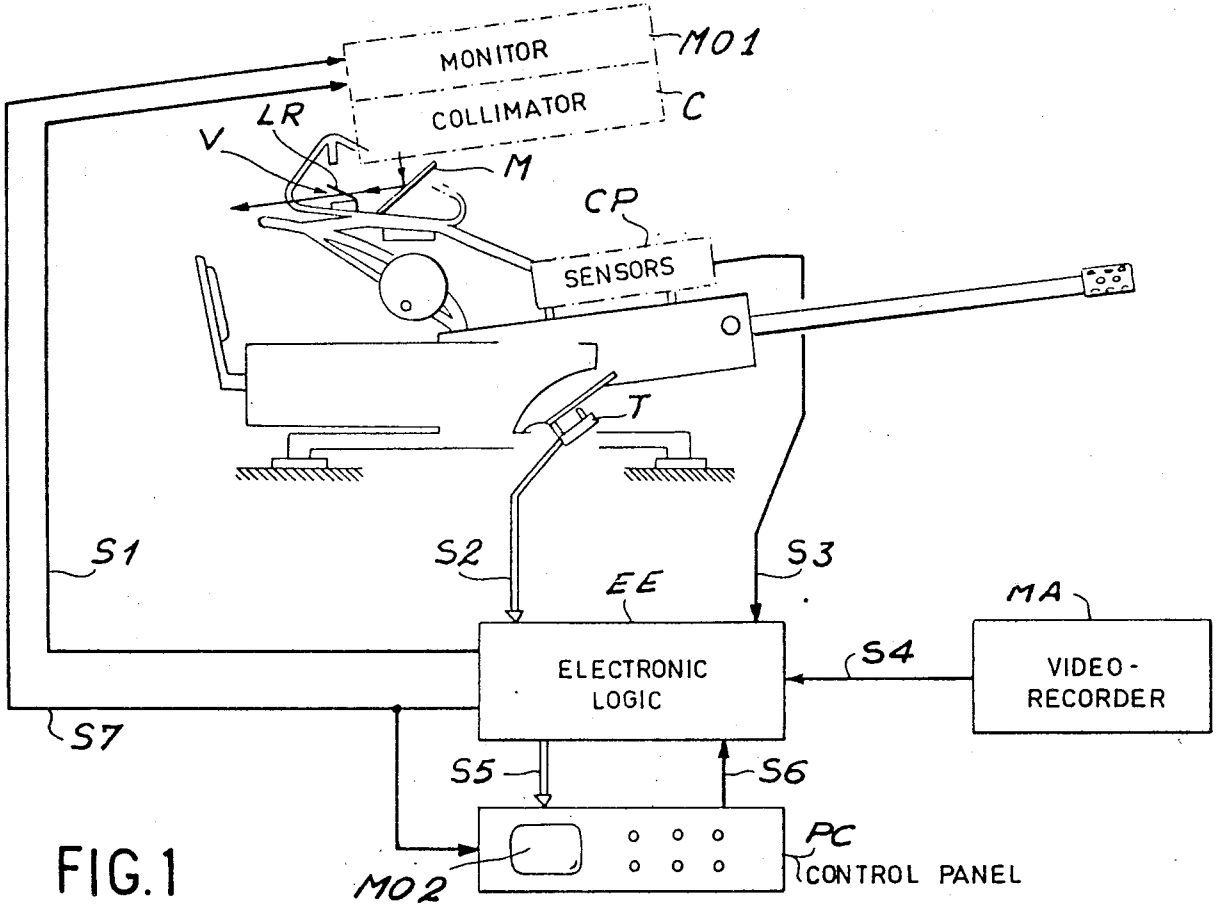
FIG. 1 is a general functional diagram of a training simulator in accordance with the invention.

The simulator illustrated in FIG. 1 comprises a number of different elements, some elements being placed on the gun and the others being located near the gun within an instructor station which is not specifically illustrated.

On the gun are mounted a first television monitor MO1, optical devices C and M associated with the gunsight V and with the first monitor and motion sensors CP. Simulated firing of a shot is initiated by the shooter by means of the real-firing control device (such as a pedal, for example) with which an electrical pickup T has been associated for training purposes. Orientation of the gun is carried out by the shooter by means of hydraulic orientation controls forming part of the gun and not shown in the drawings.

It is readily apparent that, for the purpose of firing exercises, the gun tube or other parts used under real firing conditions are not required and can therefore be removed.

The main elements of the invention which are located within the instructor station comprise an electronic logic or assembly of electronic circuits EE, a cassette-type video recorder MA and a control desk PC.

On the gun, the sight V considered in this example of construction is of a known type designated as a clear sight in which an aim is taken through a semi-reflecting plate LR from which the image of a sighting grid is reflected. The optical devices of the simulator comprise a collimator C, and a mirror M. The image produced by the monitor is reflected to infinity by the collimator and placed within the field of the gunsight V by means of the mirror M.

The control desk PC enables the instructor to direct the exercise by displaying different data defining the conditions of fire, and by controlling the action of the shooter. Said control desk comprises in particular a second television monitor MO2. The electronic logic EE receives from the video recorder MA a signal S4 which transmits (in a form which will be described later), a target image, the coordinates of the target with respect to the gun location, the coordinates of the aiming point in the gunsight, and the necessary synchronization. The video recorder MA is connected to the electronic logic EE by means of a time base corrector of a type which is known and is not illustrated in the accompanying drawings.

The electronic logic EE receives from the gun a fire-control signal S2 delivered by the sensor T, and orientation signals S3 which are delivered by the sensors CP. Said electronic logic further receives initialization and control signals S6 delivered by the control desk PC.

The electronic logic EE delivers a signal S1 to the first television monitor MO1 and delivers a signal S5 to the second monitor MO2. These two signals transmit images of the target, of the aiming point, of the tracers, and of the skylines. However, the image of the aiming point may be removed from the signal S1 by the instructor. The logic EE further delivers to the two monitors a synchronizing signal S7 which is mixed and shifted as a function of the relative movements of the target and of the gun.

The angles of orientation of the gun as well as the directions of the sensitive axes of the motion sensors are defined in FIG. 7.

The axis To' of the gun makes an angle of elevation E with its projection Th on the horizontal plane. Said axis is perpendicular to the axis of the trunnions Tt.

In the absence of tilt, the axis of the trunnions is located in the horizontal plane and in the direction Tt' which is perpendicular to To' and to Th. In the event of tilt, the axis of the trunnions Tt makes an angle F with the direction Tt', which corresponds to a rotation of the axis of the gun through an angle F. The value of this angle has been exaggerated in the figure and is actually not more than a few degrees.

The orientation of the gun is further defined by an angle A in the plane tTo' formed by the axis of the gun and the axis of the trunnions. This angle is measured from the basic position of the gun at the time of initialization.

The motion sensors are composed of a rate gyro G and of two inclinometers I1 and I2 which are represented simply by their sensitive axes.

The inclinometer I1 delivers a signal INC1 whose amplitude is proportional to sin E. Its axis is parallel to the axis of the gun. The inclinometer I2 delivers a signal INC2 having an amplitude which is proportional to the product sin F cos E. The rate gyro G delivers a signal GYR having an amplitude which is proportional to dA/dt. The axis of said rate gyro is perpendicular to the axis of the gun and to that of the trunnions.

The fictitious targets on which the firing exercises are performed are assumed to follow predetermined trajectories with respect to the location of the shooter.

The data which determine these exercises are recorded on magnetic tapes in cassettes. Each tape has a duration of 20 to 60 minutes and is formed of sequences each corresponding to one target passage.

The recorded data are formed by analog data and by digital data.

The analog data comprise a video signal which represents the target and standard synchronizing signals.

The digital data comprise the coordinates of the target in space with respect to the gun, and the coordinates of the aiming point in the gunsight. These data are recorded in association with the images during the field blanking intervals.

The target (shown in FIG. 12) is located at the center of the recorded images but its size and its attitude vary progressively as a function of its displacement on its simulated trajectory, that is to say from one image to the next. The target coordinates constituted by angles G, B and a distance Dc with respect to the shooter are shown in FIG. 8.

The recorded digital data representing said coordinates are formed by a series of values comprising on the one hand the first values of the angles concerned and then their increments which are associated respectively with the successive images and are such that:

B1, dB2, dB3, dB4 . . .

G1, dG2, dG3, dG4 . . .

and on the other hand the corresponding successive values of the distance:

D1, D2, D3 . . .

The aiming point is defined by FIG. 9. The axis To' of the gun is oriented by the shooter in such a manner as to ensure that the line of sight Tv defined by the aiming point Pv in the gunsight encounters the target C. When coincidence between the aiming point and the target is obtained, the shooter will hit the target. The angles M and N between the line of sight and the axis of the gun are defined by the laws of ballistics and by the firing parameters, the distance and velocity of the target, the nature of the projectiles, and so on, in such a manner as to ensure that the trajectories of the target and of the projectile meet at the point of impact I. The digital data relating to the aiming point are formed by two series of values comprising respectively the first values of the angles M and N followed by their successive increments such as:

M1, dM2, dM3, dM4 . . .

N1, dN2, dN3, dN4 . . .

Since the firing conditions during the exercise are known, the values of the angles M and N are calculated beforehand and then recorded.

All the digital data are recorded in accordance with known techniques which utilize synchronous coding and standard synchronizing signals.

The target images can be obtained from an orientable model and from a television camera having a variable focal length, or zoom camera. Recording is performed by means of a computer and a logic which orients the model and adjusts the focal length according to the parameters corresponding to the desired trajectory.

It is shown in the following description how the means which are inherent features of the invention enable the shooter to observe in his gunsight and the instructor to observe on the screen of the monitor MO2: the sighting grid (shown in FIG. 10), the target (FIG. 12), the tracers (FIG. 11), the aiming point, an indicator Ic which is reserved for the instructor and provides him with an indication in regard to the direction from which the target will come at the beginning of the sequence (as shown in FIG. 13), as well as skylines (shown in FIG. 14).

The coordinates Xc and Yc of the target in the gunsight (or on the screens of the monitors) result from the movements of the target and of the gun. They are obtained by supplying a line and field synchronization which is displaced with respect to the fixed synchronization produced by the video recorder, proportionally to the differences between the angles A–G and E–B (FIG. 15).

The coordinates Xp and Yp of each of the tracers forming part of a single burst are calculated, starting from the point of departure of the corresponding projectiles, by means of the fall Ech (FIG. 9) of the projectile as provided by a table, and by means of changes in axes of coordinates as a function of the angles A, E and F. The pulses for marking these tracers are produced, field by field and line by line, in correspondence with the displaced synchronization.

The coordinates Xv and Yv of the aiming point being defined with respect to the axes of the screens and to the axis of the gun, the aiming point is determined by a character generator as a function of the displaced synchronization.

Similarly, another character generator produces the target indicator Ic as a function of the displaced synchronization.

Each skyline is obtained from digital data having values proportional to the angles of elevation of a large number of points which serve to represent a line having a real appearance. These data are stored in memories at addresses in an order which is identical with that of the points of the skyline. Said data are read at each line scan, starting from one of these latter which is chosen as an initial data item, and the read address is incremented by a clock signal having a frequency which is a multiple of the fixed synchronization of the video recorder.

Figure 17:
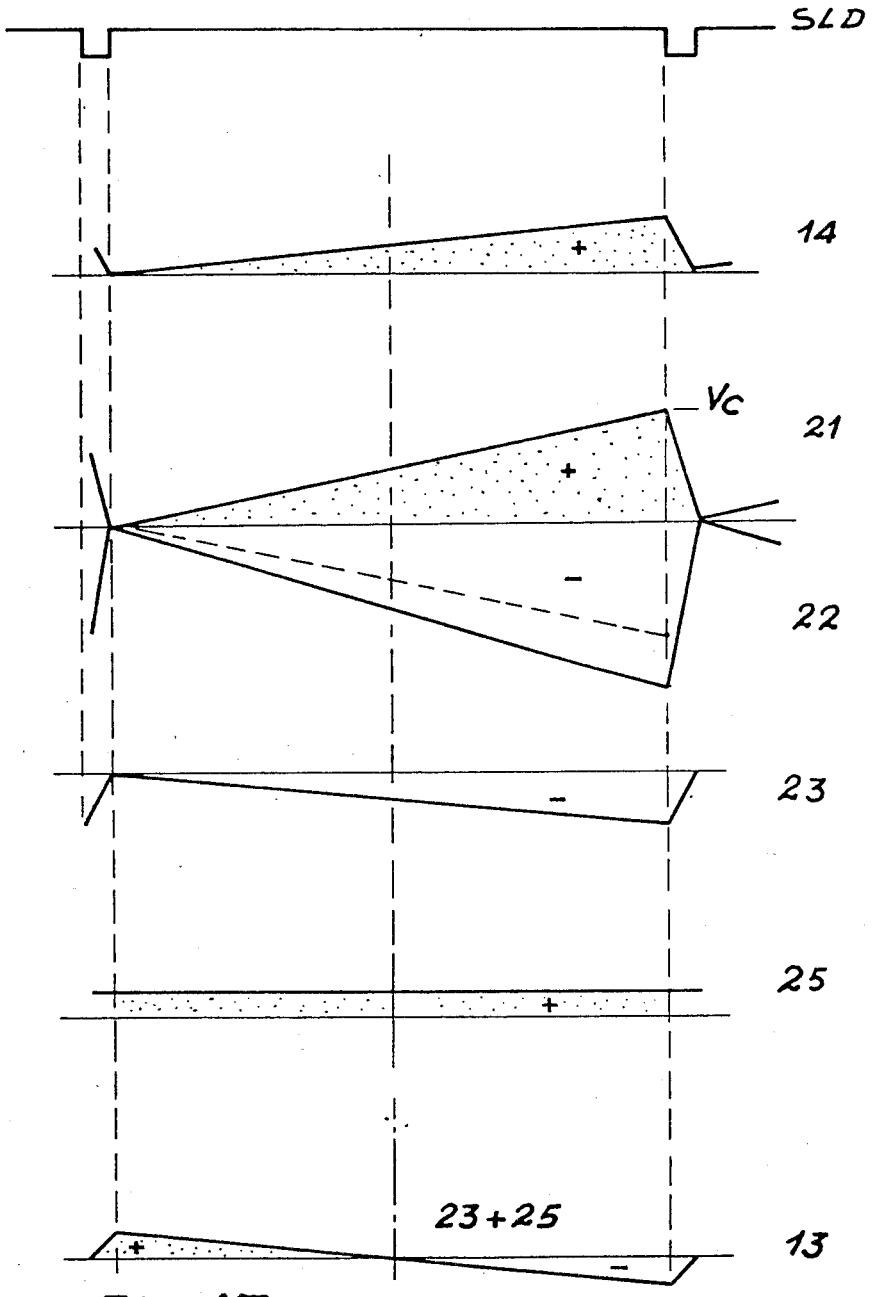
FIG. 17 represents the signals relating to the tilt-angle generator GD of FIG. 4 and a tilting signal 13 delivered by said generator.

The movement of the line in the gunsight is obtained by giving a value proportional to the angle A to the address of the initial data item and by adding to the analog signal resulting from the conversion of read digital data a periodic signal at the line scanning frequency having an amplitude which is proportional to the angle E, and a symmetrical sawtooth signal 13 having the same period and a maximum amplitude proportional to the angle and as shown in FIG. 17.

Figure 2:
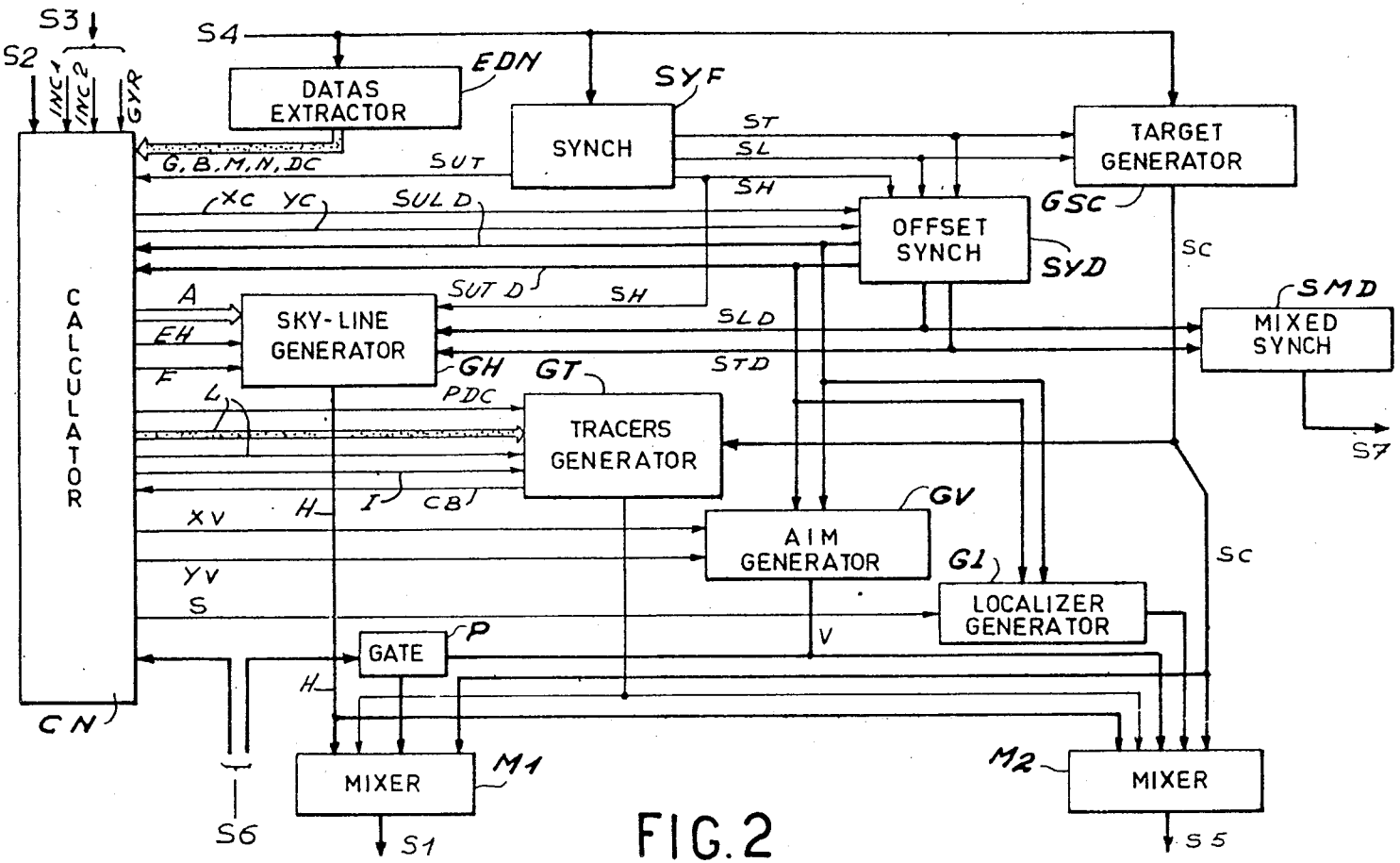
FIG. 2 is a diagram of the electronic logic EE of FIG. 1.

The electronic logic EE comprises a certain number of subassemblies interconnected in accordance with the diagram of FIG. 2.

A digital computer CN receives the signals S2 and S3 derived from the firing pedal and from the orientation sensors as well as the signals S6 derived from the control desk PC. The function of said computer will be described hereinafter.

A digital data extractor EDN receives the signal S4 from the video recorder and, in accordance with a common technique, extracts the digital data G, B, M, N and Dc from said video recorder.

Also in accordance with a common technique, a fixed synchronization subassembly SYF extracts the synchronizing pulses from the signal S4 and generates the conventional synchronizing and blanking signals SL, ST, SUT as well as a signal SH at 6.25 MHz.

A displaced-synchronization subassembly SYD receives the fixed-synchronization signals ST, SL and SH as well as the coordinates Xc and Yc of the target in the gunsight as supplied by the computer. Said subassembly delivers displaced-synchronization signals SLD, STD, SULD and SUTD, the displacement of which is proportional to the coordinates Xc and Yc. The displaced-synchronization signals in lines and fields are obtained, for example, from the zero-crossing pulses of two eight-bit counters (not shown in the drawings). The field counter is preloaded by the coordinate Yc at a frequency of one-half of the field pulses and counts at the frequency of the line pulses. The line counter is preloaded by the coordinate Xc at the frequency of the line pulses and counts at a frequency of 12.5 MHz.

In accordance with a standard technique, a subassembly SMD generates, from the signals SLD and STD, the mixed and displaced synchronizing signal S7 which is delivered to the monitors MO1 and MO2.

The target signal generator GSC on the one hand retains only the video analog portion of the signal S4 which corresponds to the target and on the other hand provides amplitude compensation by means of a suitable grey level corresponding to the image background in the case of those portions of the signal thus obtained which correspond to field and line blanking. In FIG. 15, the black bands BS which would have been produced by said blanking are indicated in dashed lines. The generator GSC thus delivers the target signal SC.

A generator GH delivers a skyline signal H which will be described hereinafter.

A generator GT delivers a tracer signal T which will be described below.

A character generator GV delivers the aiming-point signal V.

A character generator GI delivers the target localization signal LC.

Two mixers M1 and M2 deliver the image signals S1 and S5 respectively to the two monitors MO1 and MO2. Each of these signals comprises: a skyline signal H, a tracer signal T, a target signal SC, and an aiming-point signal V. The last-mentioned signal is present in the signal S1 only under the control of the instructor. The signal S5 comprises in addition a target localization signal LC.

The digital computer CN has a conventional structure comprising a 16-bit microprogrammed microprocessor, a 3 MHz clock, a random-access static working memory of the MOS type having a capacity of 4K words, a programmable read-only memory having a capacity of 6K words approximately, as well as the necessary interface circuits. The calculations relating to the projectiles are carried out by means of pre-recorded tables, projectile-tracking tables, a burst-tracking table, a burst exit table, and an indicator I which is reset to zero after each burst and at the time of general initialization of the operation.

The pre-recorded tables comprise:

trigonometric tables giving the values of the angles as functions of the sines and cosines and conversely;

a dispersion table containing N groups of two random values Ad and Ed corresponding respectively to the N possible projectiles in a burst;

a fall table giving the angle of fall Ech of the projectile as a function of time;

a distance table giving the distance of the projectile as a function of time;

a luminance table giving the luminance L of the tracer as a function of time.

The fall table, the distance table, and the luminance table, are formed by making use of known ballistic data.

The number of projectile-tracking tables is equal to the number of projectiles fired in a burst. Each table has one memory location: for each of the parameters of the projectile (coordinates Xp and Yp, distance Dp from the projectile to the firer, luminance L, periods of existence tp); for an indicator Ic which gives the order of appearance of the projectile according to the video scan of the screen; for an indicator Ip which gives the order of the projectile in the burst; and for two digits DE and PDC which indicate respectively in state 1 that Dp=Dc and that Dp>Dc, Dc being the distance from the target to the firer.

The burst-tracking table is formed by all the projectile-tracking tables classified according to the indicator Ic.

The burst exit table is formed on the basis of the burst-tracking table by a list of words defining the tracers in the image.

The tracers are considered successively in the order of their increasing Y ordinates and in the order of their increasing X abscissae in respect of one and the same ordinate.

The first tracer of the image is defined by a first word containing its ordinate and by a second word containing its abscissa.

Each tracer having a smaller abscissa on the lines following that of the first tracer is defined by a first word containing the variation dY of its ordinate with respect to the ordinate of the first tracer and by a second word containing its abscissa.

Each of the other tracers is defined by a word containing the variation dX of its abscissa with respect to the preceding tracer on the same line.

Each word which contains in addition a digit DY indicates the presence in said word, either of an ordinate (or of a variation of ordinate) in which case DY=1 or of an abscissa (or of a variation of abscissa) in which case DY=0.

Each word containing an abscissa (or a variation of abscissa) contains in addition the data L, DE and PDC relating to the tracer considered.

The operation of the calculator CN takes place in accordance with a program comprising four successive periods having orders P, P+1, P+2, and P+3 having a duration of 20 ms initiated by the field blanking signal SUT.

In accordance with an interruption sub-program, the amplitude of the signal GYR is sampled at a period T' in the vicinity of T/4 and the values obtained dA/dt=A' are stored in memory.

In accordance with a sub-program SPGYR, at each period of order P and P+2 and in the case of each value A', a value An is calculated from the relation:

$$A_n = A_{n-1} + \frac{T}{2}(3A'_{n-1} - A'_{n-2})$$

with, at the time of initialization:

$$A_{n-1}=A_o=0A'_{n-1}=A'_o \text{ and } A'_{n-2}=0$$

In accordance with a sub-program SPAC, at each period of order P and P+2, the sampled value of the signal INCI is proportional to sin E; the value of $E_n$ is given by the trigonometric tables which then provide the useful values of sin E and cos E; the sampled value of the signal INC2 is divided by cos E; the arc sine of the quotient obtained is equal to the value of the angle F and the tables give the corresponding values of sin F and cos F; the value F is delivered to the skyline generator GH; and the trigonometric tables also supply the values of sin A and cos A starting from $A_n$.

In accordance with a sub-program SPDF, at each period of order P and P+2, the increments of the angles E and A are calculated from the relation:

$$E_n - E_{n-1} = dE_n$$

with $$E_1 - E_o = dE_1 \text{ and } E_o = 0$$

and $$A_n - A_{n-1} = dA_n$$

In accordance with a sub-program SPBE, at each period of order P, if the indicator I is zero, the projectile-tracking tables are reset to zero and the dispersion table is renewed; the indicator I is then set at 1.

In accordance with a sub-program SPBB, at each period of order P: the indicator IP is incremented if the level of the signal S2 indicates that the shooter is depressing the firing pedal and if the value N of the indicator Ip is lower than N max. A tracking table is assigned to the new projectile thus processed. The value of Ip is assigned to the indicator Ic of this table; the values Ed and Ad of the dispersion which are assigned in the dispersion table to the order N are transferred respectively to the memory locations Xp and Yp; the time interval tp is made equal to 0.

In accordance with a sub-program SPBC, at each period of order P or P+2, the projectile-tracking tables are classified in order to form the burst-tracking table by means of the indicator Ic in the order of increasing values of Y and then in the order of the increasing values of X in respect of the same Y.

In accordance with a sub-program SPBD, at each period of order P or P+2, the contents of the burst-tracking table are transferred into the exit table after conversion.

In accordance with a sub-program SPB, at each period of order P+1 or P+3, the values of falls Ech of the fired projectiles are sought in a table, whereupon the sums S(dE) and S(dA) are formed from the instant of departure of each projectile.

Again in accordance with the sub-program SPB, at each period of order P+1 or P+3, in each projectile-tracking table, the value tp is incremented by 2T and the values DP, L, are updated by means of the tables as a function of tp. The calculations:

$$(Ech+Ed)-S\ (dE+dA\cdot\sin F)=Yp$$

and $$Ad-S\ (dA\cdot\cos F)=Xp$$

are performed and their results are transferred respectively into the memory location Yp and into the location Xp.

In accordance with a sub-program SPC, at each period of order P+1 or P+3 and in the case of each projectile-tracking table, the distance Dp is compared with the distance Dc; if Dp=Dc, DE=1; if Dp>Dc, PDC=1.

In accordance with a sub-program SPBF, at each period of order P+1 or P+3, the contents of the memory locations Xp and of the memory locations Yp are converted by means of the relations:

$$Xp\cos F+Yp\sin F\rightarrow xp;\ -Xp\sin F+YP\cos F\rightarrow Yp$$

In accordance with a sub-program SPI, at each period of order P or P+2, the coordinates Xc and Yc of the target as well as the coordinates of the aiming point Xv and Yv are calculated from the relations:

$$Xc_n=Xc_{n-1}+dG_n-dA_n$$

$$Xc_1=G_1-dA_1\ and\ dA_1=A_1$$

$$Yc_n=Yc_{n-1}+dG_n-dE_n$$

$$Yc_1=G_1-dE_1$$

$$Xv=M_n=M_{n-1}+dM_n$$

$$Yv=N_n=N_{n-1}+dN_n$$

In accordance with a sub-program SPC, at each period of order P+1 or P+3, a signal CB delivered by the generator GT is processed by the computer and the luminosity L of the tracer which produces a direct hit is cancelled.

In accordance with an interruption sub-program, the digital data G, B, N, M and Dc are searched in a buffer register of the extraction circuit EDN and are placed in a table of the computer for logical utilization.

In accordance with a sub-program HORZ, at each period of order P or P+2, the skyline elevation in the field of view is calculated in accordance with the relation:

$$Eh_n=Eh_{n-1}+dE_n$$

with $$Eh_o=E_1$$

In accordance with the sub-program HORZ, the value $A_n$ is supplied to the skyline generator GH.

Figure 3:
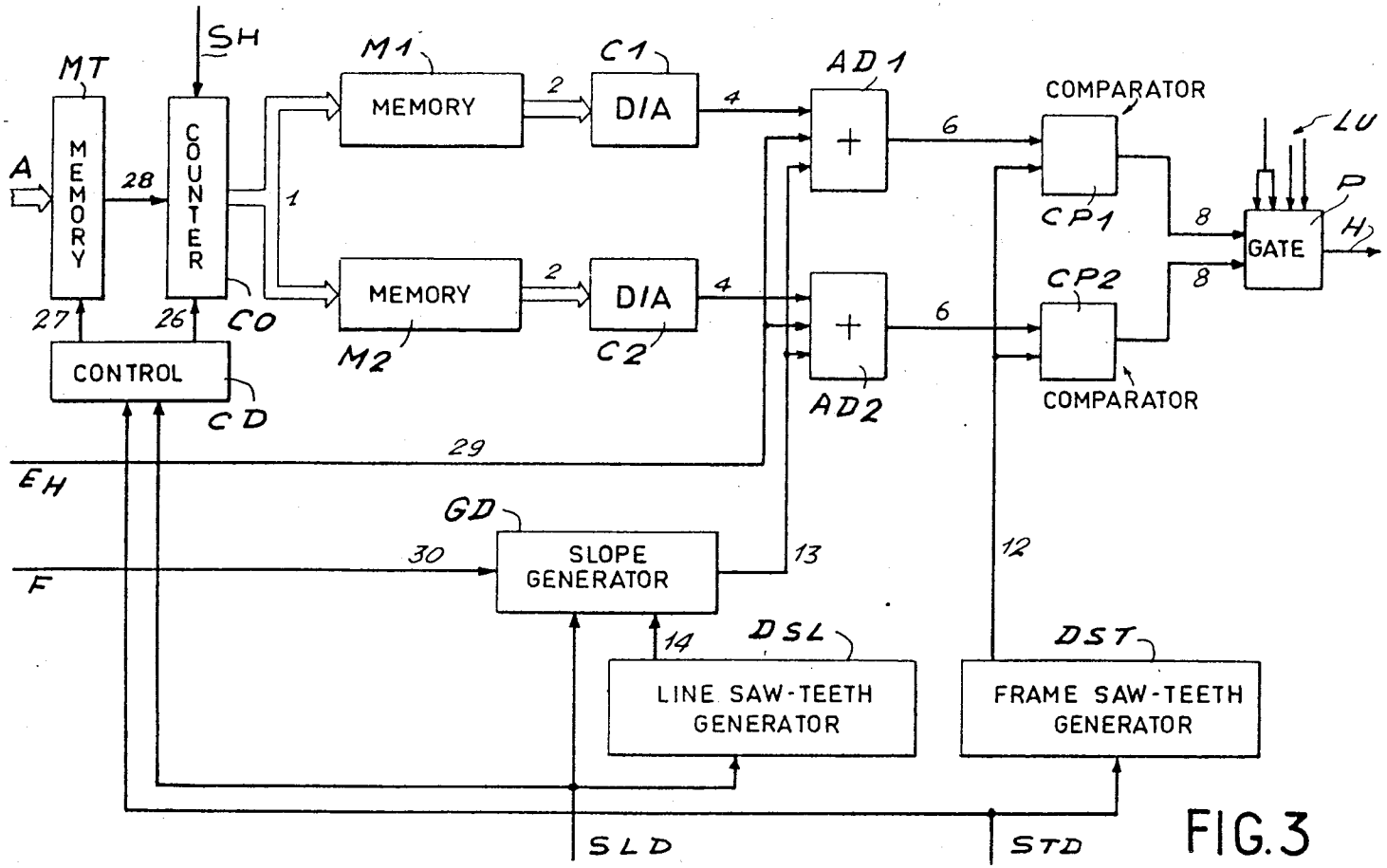
FIG. 3 is a diagram of the skyline generator GH of FIG. 2.

The skyline generator GH shown in FIG. 3 delivers a skyline signal H which makes it possible to obtain two skylines in this example of construction. To this end, the generator GH comprises in particular two identical circuit chains each consisting of a digital memory (M1 and M2), a digital-analog converter (C1 and C2), an adder (AD1 and AD2) and an amplitude comparator (CP1 and CP2).

The generator further comprises:

memory-reading circuits each comprising a buffer memory MT, a counter CO and a control circuit CD;

a gate P which selects, in order to constitute the signal H, a signal LU of predetermined amplitude corresponding to the brightness to be given to the screens of the monitors at each scanning instant;

a slope generator GD, the sawtooth output signal of which has a slope proportional to the angle F and produces a corresponding inclination of the profiles on the screens;

two generators DST and DSL for producing sawtooth signals in fields and in lines.

Figure 16:
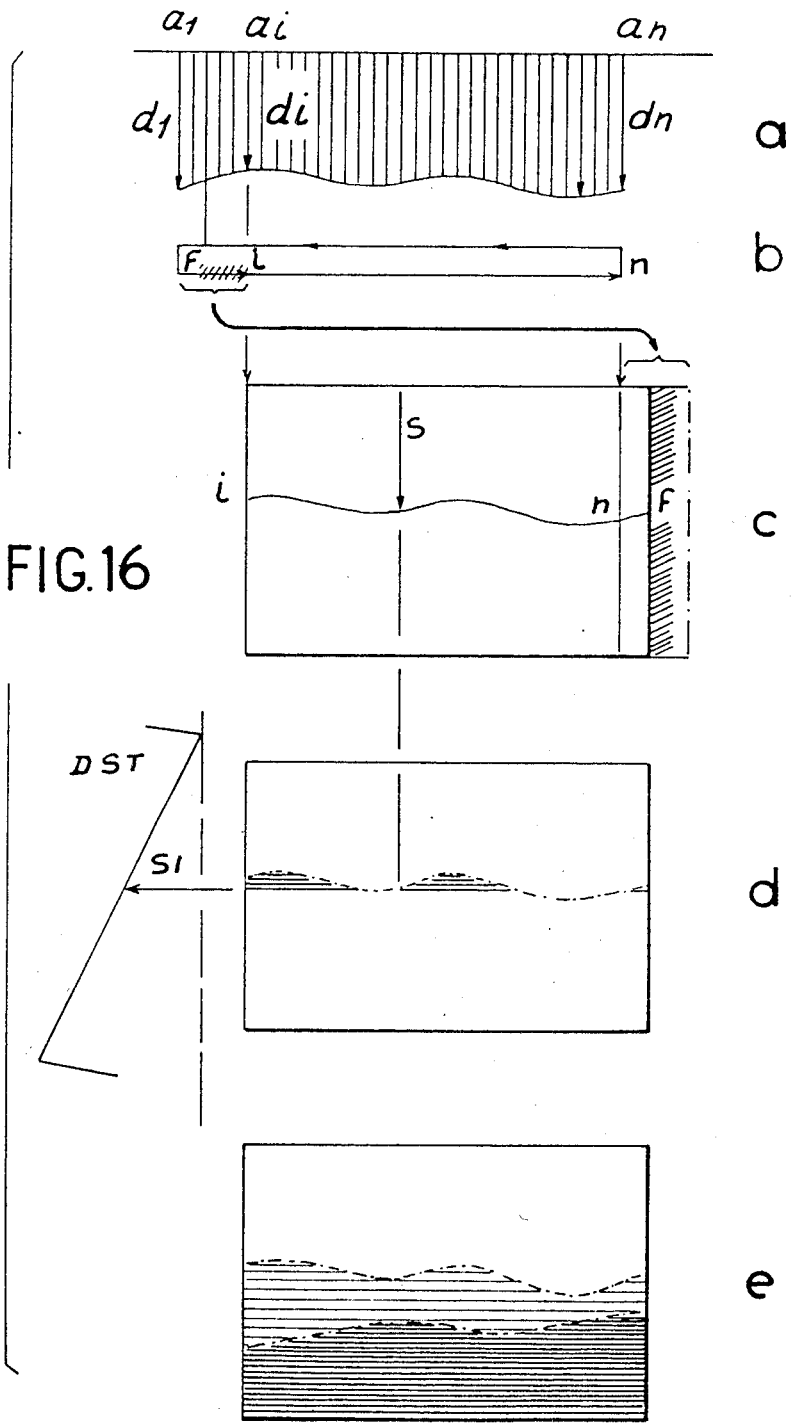
FIGS. 16*a* to 16*c* show the method adopted for obtaining skylines from stored digital data Do to Dn.

A skyline is determined by a set of N digital data $D_1$ to $D_n$ which are inversely proportional for example to the angles of elevation in the gunsight of the different points which form said line (as shown in FIG. 16*a*). The digital data are stored in an N-address memory M. Said data are delivered successively by the counter CO in which counting is initiated by the signal SH having a frequency of 6.25 MHz, namely 400 times the line scanning frequency. Since the number N of addresses is fixed at 400, reading of all the data takes place repetitively at the line scanning frequency (FIG. 16*b*). The useful duration of the line scan is shorter than the line scanning period and the skyline is obtained at each scan by means of a number of data which is smaller than 400. These useful data correspond to the sequence of addresses such as, for example, $a_i \ldots a_n \ldots a_l \ldots a_f$. The reading operation begins at the address $a_i$ and ends at the address $a_f$. Reading of the addresses forming the remainder of the cycle and comprised between $a_f$ and $a_d$ is carried out during the line blanking interval.

In order to take into account the rotation of the gun as a function of the angle A, the initial address $a_i$ varies proportionally to said rotation in the ordered sequence of addresses of the memory.

Moreover, since the skyline does not need to correspond in any respect to a real landscape and is intended to provide only an illusion of a natural environment, the address $a_i$ is simply made equal to the value of the angle A, subject to a conversion of units. This value is delivered by the computer, placed in the buffer memory MT and preloaded in the counter CO under the control of the circuit CD by the signals 27 and 26 before the first line of each field.

The connection 28 between the buffer memory MT and the counter CO is such that the value A is transmitted and modulo-400 preloaded.

The remainder of the digital data read in the memory M is converted by means of a digital-to-analog converter C to a periodic signal whose amplitude S represents at each period the skyline which is sought (FIG. 16*c*). To this signal are added in an adder AD two signals which make it possible to displace the profile in the screens as a function of the rotations of the gun through the angles E and F. The two signals under consideration are the signal 29 whose amplitude is proportional to the angle E and the signal 13 which will be described hereinafter. The signal 6 delivered by the adder AD is compared with a sawtooth signal 12 within an amplitude comparator CP. The comparator CP delivers a signal 8 whose amplitude during each field scan is zero as long as the amplitude $S_1$ of the field sawtooth 12 is smaller than the amplitude S of the signal 6 and has a constant amplitude when it is smaller (FIG. 16*d*). This figure shows that the signal derived from the comparator has the effect of marking the screens and displaying two zones of different brightness separated by the desired skyline.

Figure 4:
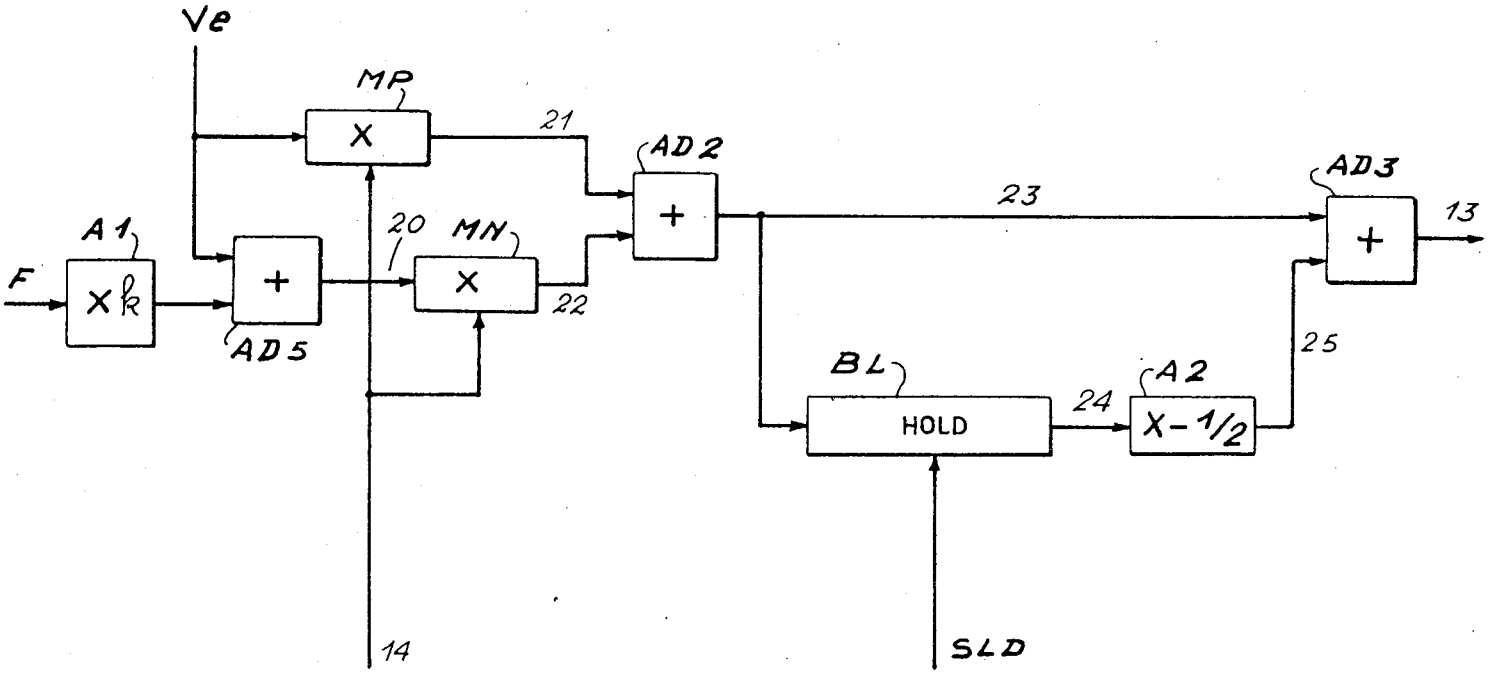
FIG. 4 is a diagram of the slope or tilt-angle generator GD of FIG. 3.

The skyline generator described in this example is designed for two lines and comprises two comparators CP, the output signals 8 of which are applied to a digital control gate P. The levels of these two signals form a code which serves to designate each of the three zones determined by the two lines (FIG. 16*e*). These zones must exhibit different luminances on the screens. In order to form the signal H, the gate P selects as a function of the codes one of the signals LU having a predetermined amplitude and corresponding to the luminance of the designated zone. Three signals LU are sufficient for the four possible values of the code and are delivered by potentiometer bridges. The slope signal 13 is delivered by the generator GD (the diagram of which is shown in FIG. 4) by means of the signal So which transmits the value of the angle F, the displaced-line synchronizing signal SLD, and a displaced-line sawtooth signal 14.

The signal 13 (FIG. 17) is determined so as to ensure that, by adding said signal to the signals 4, an inclination of the skylines equal to the angle F is produced on the screens. The production of said signal takes into account the gains Gx and Gy of the "horizontal" and "vertical" amplifying channels of the monitors and the voltage Vx corresponding to the maximum horizontal deviation. If the angle F remains of small value, the level Vy which results in an inclination F on the screens is:

$$Vy = F \times (Gx/Gy) \times Vx = kF$$

FIG. 17 thus shows how the signal 13 is obtained from a displaced-line synchronizing signal SLD, from a line sawtooth signal 14 having a value F, and from a constant voltage Vc such that $Vc > |kF|$. Two sawtooth signals 21 and 22 having positive and negative polarities are obtained from the signal 14 and from two multipliers MP and MN. The multiplier MP (positive gain) receives the voltage Vc and the sawtooth signal and the multiplier MN (negative gain) receives the sawtooth signal and a signal Vc+kF obtained from an adder AD5 which in turn receives the voltage Vc and the signal F multiplied by k via an amplifier A1. These two signals are added in an adder AD2 which delivers a signal 23 having a maximum amplitude kF. This signal must be made symmetrical with respect to the zero level. To this end, its maximum level is stored in a blocking circuit BL which is controlled by the signal SLD. The output signal 24 of said blocking circuit is then applied to an inverting amplifier A2 having a gain of $\frac{1}{2}$. The signal 25 thus obtained is added to the signal 23 in an adder AD3 which delivers the required signal 13.

Figure 5:
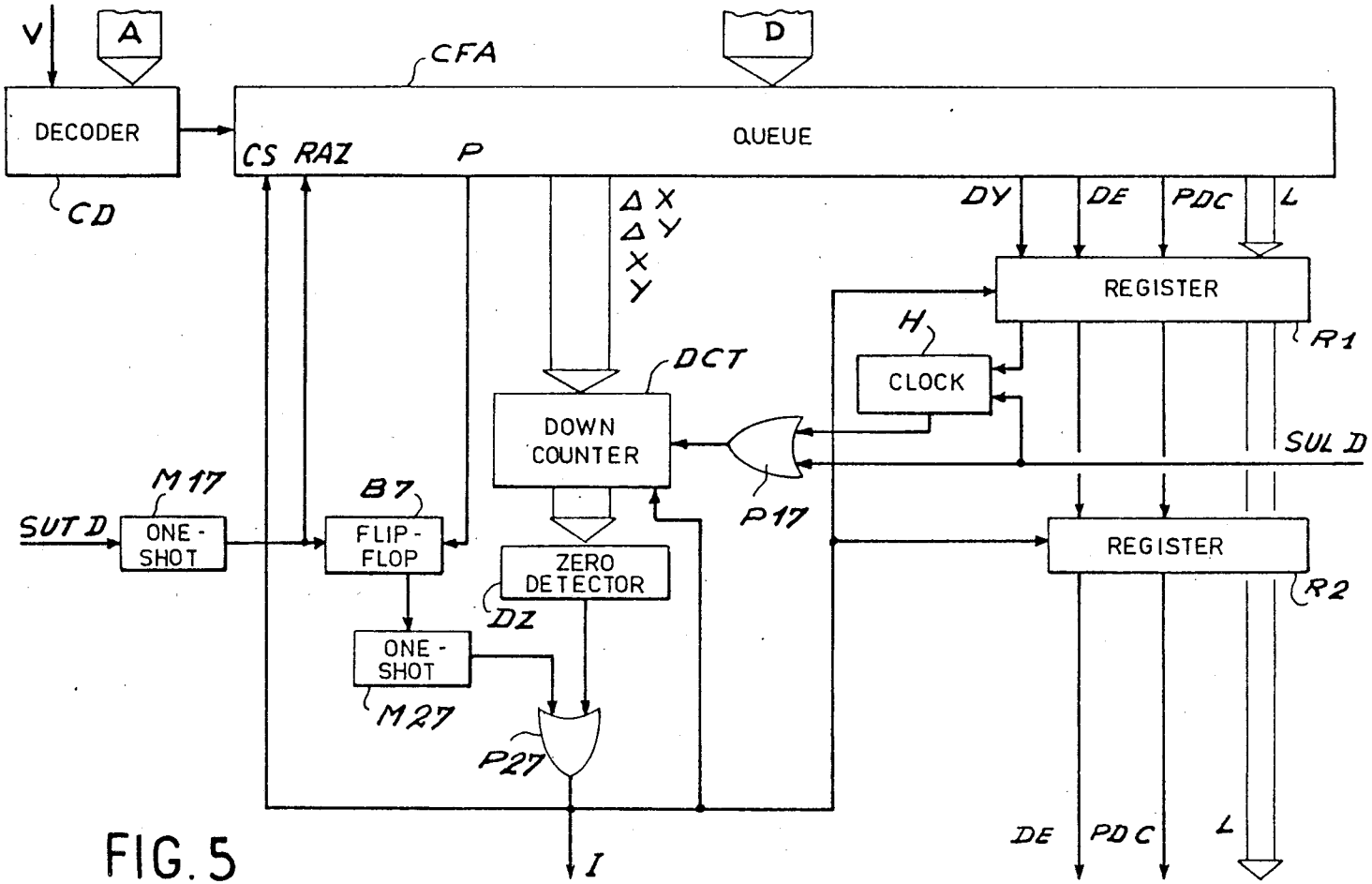
FIG. 5 is a diagram of the interface circuits which form part of the calculator CN of FIG. 2 and serve to supply the circuit GT of FIG. 5.

Apart from the interface circuits which form part of the calculator CN, there are shown in FIG. 5 those which relate to the tracer generator GT.

Said interface circuits mainly comprise a conventional circuit CFA known as a "queue" circuit, a count-down circuit DCT, a zero detector DZ, and a clock H.

During each field blanking interval, the circuit CFA receives all the words contained in the burst exit table and then delivers these words one by one during the following field interval.

The successive operations which consist in loading the count-down circuit DCT with the coordinates delivered by the circuit CFA are initiated by pulses I. Backward counting of the count-down circuit DCT is carried out via an OR-gate P17 either by the signal SUL in the case of the coordinates Y and dY or by a clock H in the case of the coordinates X and dX.

The clock H delivers a signal having a frequency which is equal to N times the line frequency, N being the number of points visualized on a line when it is initiated by the signal SUL and when it is not inhibited by a digit DY delivered by the register R1.

When the zero detector DZ detects that counting-down of a coordinate has been completed, said detector delivers a pulse I which first passes through an OR-gate P27 and initiates loading of the count-down circuit DCT with the following coordinate, loading of a register R1 with the digit DY and with the digits DE, PDC, and L in the case of a coordinate X or dX, and calling of the following word into the circuit CFA via the input CS of this latter.

The pulses I are also delivered to the tracer generator. Those pulses which are emitted during a line and not during a field or line blanking interval and which therefore result from counting-down of the coordinates X and dX determine the marking of tracers by means of subsequent conversions.

The register R1 and a register R2 which is loaded from R1 by means of a pulse I make it possible for the interface circuits to retain the digits DE, PDC, and L temporarily and to deliver said digits only from the instant at which the pulse I resulting from count-down of the coordinates X or dX has been emitted.

A monostable circuit M17 detects the beginning of the signal SUT and resets a flip-flop B7 to zero as well as the circuit CFA via its input RAZ.

After receiving and recognizing its address on the address bus A as well as a validation signal V, a decoding circuit CD permits loading of the circuit CFA with the words of the exit table which are then presented successively on the data bus D.

After loading, the circuit CFA delivers the first word of the table at its output and initiates a reversal of state of the flip-flop B7 by means of a signal P(ready). This change of state triggers a monostable circuit M27 which delivers a first pulse I. Among other functions, this pulse initiates loading of the down-counter with the first word of the table.

The operation of these circuits continues until complete delivery of all the words contained in the circuit CFA and begins again for the following field after a further loading of the circuit just mentioned.

Figure 6:
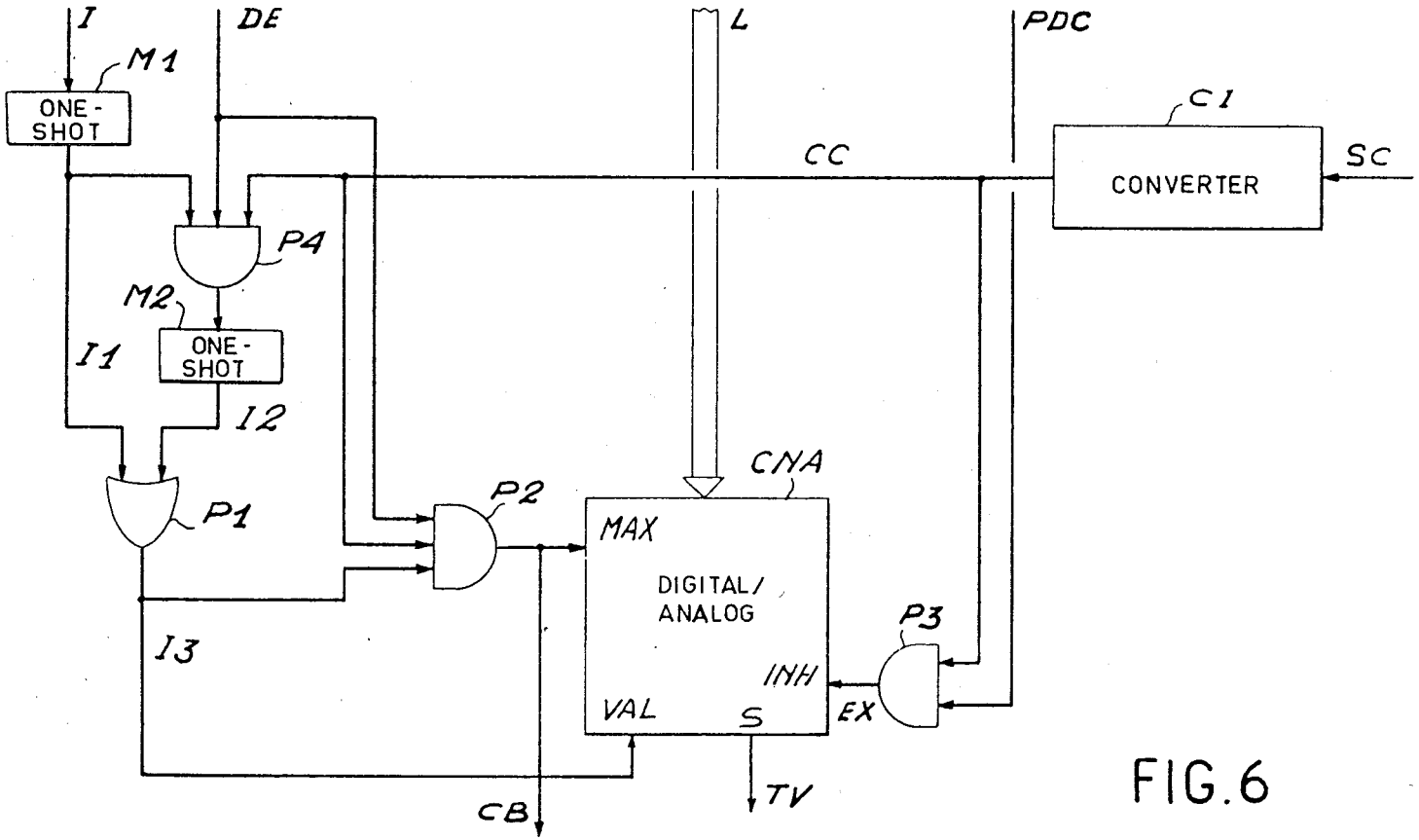
FIG. 6 is a diagram of the tracer generator GT of FIG. 2.

The tracer generator GT shown in FIG. 6 receives the signals I, DE, PDC, and L delivered by the interface circuits of FIG. 5 as well as the signal SC delivered by the circuit GSC. The generator in turn delivers the signal TV to the two mixers M1 and M2 (shown in FIG. 2) as well as a signal CB to the computer CN. Said generator mainly comprises a conventional digital-to-analog converter CNA which receives the luminance L and delivers the pulse TV as initiated by a pulse I3. Said pulse TV has an amplitude which is proportional to the value L and a duration which is equal to that of the pulse I3. Said converter can be forced either by the signal CB which imposes a maximum amplitude for the pulse TV or by a signal Ex which suppresses the pulse TV. In accordance with a method which is conventional in video insertion techniques, a circuit CI converts the target signal SC to a keying signal CC.

In the absence of impact (DE=0 or CC=0), the pulse I3 is constituted by a pulse I1 which is delivered by a monostable circuit M1 triggered by the pulse I and which passes through an OR-gate P1.

In the event of impact (DE=1 and CC=1), the duration of the pulse I3 is increased. This pulse is then formed by means of the gate P1 as a result of the combination of two consecutive pulses, namely the pulse I1 and a pulse I2 delivered by a monostable circuit M2. The time-duration of said pulse I3 is equal to the sum of the time-durations of the two last-mentioned pulses The circuit M2 is triggered by a signal delivered by an AND-gate P4 and resulting from the simultaneous presence of the pulse I1 and of the signals DE and CC.

Furthermore, in the event of impact, the converter CNA is forced (maximum luminance) by a signal CB delivered by an AND-gate P2 which is activated simultaneously by the pulse I3 and by the signals CC and DE. Said signal CB is also directed to the calculator CN which reduces the luminosity of the tracer to zero after a direct hit.

When the tracer is concealed by the target (PDC=1 and CC=1), the converter is inhibited by the signal Ex. This signal is delivered by an AND-gate P3 and results from the presence of the signals PDC and CC which are equal simultaneously to 1.

The aiming-point generator GV is constructed in accordance with the conventional techniques of symbol generators. Said generator receives the coordinates Xv and Yv of the aiming point and delivers the aiming-point signal PV.

What is claimed is:

1. A simulator for simulating firing small-bore guns at simulated targets, said simulator being mounted on a gun provided with a gunsight and with controls for aiming said gun and firing a fictitious shot, comprising:

orientation sensor means, fixed to said gun, for delivering signals which determine orientation of said gun;

firing sensor means, fixed on the firing control of said gun, for delivering a signal indicating instants of firing said gun;

first monitor means, coupled to said gunsight, for introducing in said gunsight an image of a simulated target, an image of tracers, an aiming-point image, and skylines;

video recorder means for reading a magnetic tape on which is recorded a video signal representing a target which is located at a center of said images and has a size and attitude which vary as a function of a predetermined simulated trajectory, and digital data recorded in field blanking intervals of said video signal and representing coordinates of said target and coordinates of an aiming point to be superimposed on said target in said gunsight by orienting said gun;

control means having second monitor means for displaying the same images as are displayed in said first monitor means plus a target indicator, and controls for selecting modes of operation of said simulator, for providing control signals which control the firing simulation; and logic means for receiving the signals of said orientation sensor means and said firing sensor means and said video recorder means and said control means, and for generating image signals and a mixed synchronizing signal to be transmitted to said first and second monitor means.

2. A simulator according to claim 1, wherein said logic means includes:

digital computer means for receiving (a) the signals of said orientation sensor means and said firing sensor means (b) said control signals (c) said digital data, and (d) fixed-synchronization signals, and for producing target image displacement signals and signals for generating tracers, skyline, aiming point and target localization;

digital data extractor means for extracting said digital data from said video signal, said data being sent to said computer means;

fixed-synchronization means for extracting fixed-synchronization pulses from said video signal;

displaced synchronization means for generating from said target image displacement signals and from said fixed-synchronization pulses displaced-synchronization signals, including displaced line and field synchronization signals, which make it possible to displace the image of said target on said first and second monitor means as a function of a simulated trajectory of said target and of the orientation of said gun;

mixed synchronization means for generating, from said displaced-synchronization signals, said mixed synchronizing signal which is transmitted to said first and second monitor means and which groups together field and line synchronization pulses;

target signal generator means for suppressing, in said video signal, field and line blanking intervals and replacing them by a grey level of a video signal background to produce a target signal;

skyline generator means for obtaining a skyline signal from the skyline-generating signal;

tracer generating means for obtaining a tracer signal from the tracer-generating signal;

aiming-point generator means for obtaining an aiming signal from the amining-point generating signal;

localizer generator means for obtaining a localizing signal from the target localization-generating signal;

first mixer means for receiving said target signal, said skyline signal, said tracer signals, and said aiming signal via a gate which is opened by said computer, and for delivering of said images to said first monitor means; and second mixer means for receiving said target signal, said skyline signal, said tracer signal, said aiming signal, and said localizing signal, and for delivering said images to said second monitor means.

3. A simulator according to claim 2, wherein said skyline generator means includes:

buffer memory means for receiving from said computer an initial address corresponding to an angle of rotation of said gun;

counter means, initialized by contents of said buffer memory means, for counting a signal having a frequency equal to a number N of points which are representative of one line of an image;

control circuit means for receiving said displaced-synchronization signals and carrying out loading of said buffer memory means and initialization of said counter means before a first line of each field;

at least one memory containing N values of angles of elevation of said N points representing said skyline, said memory being read under control of said counter means;

at least one digital-to-analog converter means for converting digital values read in said at least one memory to an analog signal;

means for generating, from a signal which measures inclination of said skyline, and from said displaced line synchronization signal, a symmetrical sawtooth slope signal to produce an inclination of said skyline;

at least one adder means for forming an output means which is the sum of said analog signal, said slope signal and an elevation signal which produces a displacement in height of the skyline;

first generator means for producing a first sawtooth signal at a frequency corresponding to a frequency of said displaced field synchronization signal;

at least one comparator means for comparing said output signal of said adder means with said sawtooth signal and delivering a binary signal which indicates the result of said comparison; and a gate for selecting at least one of two predetermined voltage sources corresponding to two distinct luminances of said monitor means under control of said binary signal, and for deliverying said skyline signal.

4. A simulator according to claim 3, wherein said means for generating said signal includes:

second generator means for producing a second sawtooth signal at a frequency corresponding to a frequency of said displaced line synchronization signal;

first multiplier means for multiplying said second sawtooth signal by a constant voltage and delivering a positive sawtooth signal;

first amplifier means for multiplying by a predetermined coefficient said signal which measures inclination of said skyline and producing an output signal;

first adder means for adding said output signal of said first amplifier means and said constant voltage and producing an output signal;

second multiplier means for multiplying said second sawtooth signal by said output signal of said first adder means and delivering a negative sawtooth signal;

second adder means for adding said positive and negative sawtooth signals and providing an output signal;

blocking means for storing a maximum level of said output signal of said second adder means;

second amplifier means for multiplying said level stored in said blocking means by a coefficient $-\frac{1}{2}$; and third adder means for adding the output signals of said second adder means and said second amplifier means and delivering said slope signal.

5. A simulator according to claim 2 further including an address bus and a data bus and interface circuits provided between said digital computer means and said tracer generator means, comprising:

a decoding circuit coupled to said address bus and to a validation connection;

a queue circuit connected to said data bus and loaded by said data bus under control of said decoding circuit;

a flip-flop positioned by said queue circuit when said que cirucit is loaded;

a monostable circuit triggered by said flip-flop;

a first OR-date having an input connected to said monostable circuit and delivering loading pulses;

a down-counter loaded by said queue circuit under control of said loading pulses for counting down pulses;

a zero detector which detects an end of said counting down and which has an output connected to said input of said first OR-gate;

a first register loaded by said queue circuit under control of said loading pulses;

a second register loaded by said first register under control of said loading pulses and having an output which delivers data which are necessary for controlling said tracer generator;

a clock controlled by said displaced line synchronization signal, said clock being inhibited by a signal derived from said first register;

a second OR-gate for receiving said clock signal and said displaced line synchronization signal, and for initiating counting down by said down-counter; and a second monostable circuit triggered by said displaced field synchronization signal for repositioning said flip-flop and resetting said queue circuit to zero.

6. A simulator according to claim 5, wherein said tracer generator includes:

a third monostable circuit triggered by said loading pulses and providing an output signal;

an insertion converter which receives said target signal and delivers a keying signal;

a first AND-gate which receives said output signal of said third monostable circuit, said keying signal, and an impact signal;

a fourth monostable circuit triggered by said first AND-gate and providing an output signal;

a third OR-gate connected to said output signals of said third and fourth monostable circuits;

a second AND-gate which receives said keying signal, said impact signal and said output signal of said third OR-gate, and provides an output signal;

a third AND-gate which receives said keying signal and a signal for occultation by said target and provides an output signal;

a digital-to-analog converter which receives a digital tracer-luminance signal, is validated by said output signal of said third OR-gate, is forced to a maximum by said output signal of said second AND-gate, is inhibited by said output signal of said third AND-gate, and delivers said tracer signal.

* * * * *